United States Patent [19]

Santambrogio

[11] Patent Number: 5,065,297

[45] Date of Patent: Nov. 12, 1991

[54] STUDY LAMP

[75] Inventor: Angelo Santambrogio, Milan, Italy

[73] Assignee: PAF S.r.l., Italy

[21] Appl. No.: 464,887

[22] Filed: Jan. 16, 1990

[30] Foreign Application Priority Data

Sep. 19, 1989 [IT] Italy ..... 21760 A/89

[51] Int. Cl.[5] ..... F21S 1/12

[52] U.S. Cl. ..... 362/413; 362/287; 362/402; 362/427

[58] Field of Search ..... 362/287, 403, 410, 413, 362/419, 427

[56] References Cited

U.S. PATENT DOCUMENTS

| | | | |
|---|---|---|---|
| 2,299,683 | 10/1942 | Curtis | 362/413 X |
| 3,369,117 | 2/1968 | Nicolosi | 362/413 X |
| 4,165,530 | 8/1979 | Sowden | 362/413 X |
| 4,706,172 | 11/1987 | Lebowitz | 362/413 X |

*Primary Examiner*—Stephen F. Husar

*Attorney, Agent, or Firm*—Lerner, David, Littenberg, Krumholz & Mentlik

[57] ABSTRACT

A study lamp wherein the electric bulb is supported in an etheral fashion on a structure which is both rigid and lightweight, comprises a base, a boom having one end connected to the base by means of a hinge and the other end arranged to hold a bulb socket, the boom being made up of three thin plate-like elements which are a sliding fit inside one another.

11 Claims, 1 Drawing Sheet

10
11
35b
25
23
21
19
20
35a
36b
37b
24
37a
27
22
26
36a
14
38
40
39
18a
18b
8
1
5
30
9
29a
II
AE
17
13
33
28a
34a
3
31
16b
16a
12
15
4
35b
28b
34b
29b
7
6
2
32a
32b
41

STUDY LAMP

BACKGROUND OF THE INVENTION

This invention relates to a study lamp of a type which comprises a base, a boom having one end connected to the base by means of a hinge and the other end holding a bulb socket, and an electrical connection between the base and the bulb socket.

Study lamps of this kind have been known and are widely used, but have some drawbacks yet to be overcome. In particular, owing to the mechanically complex construction of the boom, they are generally bulky, massive, and heavy to the point of interfering with one's viewing range and unrestricted usability of the desk or table surface.

SUMMARY OF THE INVENTION

The problem that underlies this invention is to provide a study lamp of the type specified above, which has such constructional and performance characteristics as to obviate the above-noted drawbacks.

In accordance with one embodiment of the present invention, there is provided a study lamp constructed of a base, a boom having one end connected to the base by mean of a hinge and the other end holding a bulb socket, and an electrical connection between the base and the bulb socket, characterized in that the boom has in cross-section a thin plate-like profile.

In accordance with another embodiment of the present invention, there is provided a study lamp constructed of a base; a boom having a thin plate-like configuration, one end of the boom connected to the base by means of a hinge and the other end holding a bulb socket, the boom including plate-like elements which are slidingly fit inside one another to provide for telescoping extension of the boom, the elements including a first element U-shaped and connected to the base at the cross line of the "U", a second element U-shaped and slidingly fit between the legs of the U-shape of the first element, and a third element holding the bulb socket slidingly fit between the legs of the U-shape of the second element; and an electrical connection between the base and the bulb socket.

BRIEF DESCRIPTION OF THE DRAWINGS

This problem is solved by a lamp as indicated being characterized in that the boom has a thin plate-like configuration.

Further features and the advantages of a lamp according to the invention will become apparent from the following detailed description of a preferred embodiment thereof, given by way of illustration and not of limitation with reference to the accompanying drawing, where.

DESCRIPTION OF THE PREFERRED EMBODIMENTS

Figures 1, 2, 3, 4, 5:
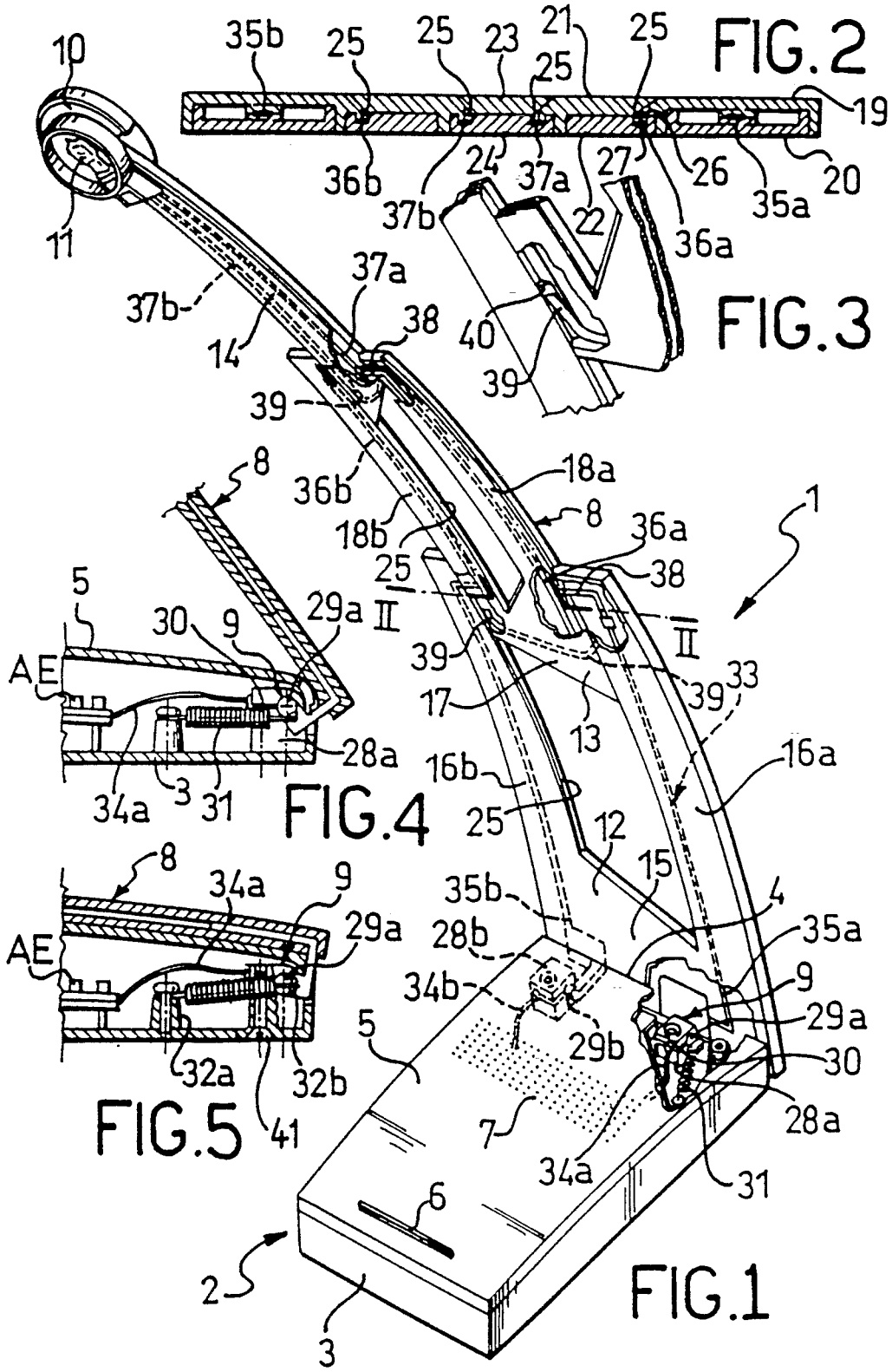
FIG. 1 is a part-sectional perspective view of a lamp according to the invention.
FIG. 2 is an enlarged scale, sectional view of a detail of the lamp shown in FIG. 1, taken along the line II—II.
FIG. 3 is a part-sectional perspective view, drawn to an enlarged scale, of another detail of the lamp shown in FIG. 1.
FIG. 4 is a sectional view taken through a further detail portion of the lamp shown in FIG. 1.
FIG. 5 is a sectional view of the same detail portion as in FIG. 4, but taken at a different stage of the lamp operation.

With reference to the drawing views, generally indicated at 1 is a study lamp according to the invention.

The lamp 1 comprises a base 2 formed by a flattened box-type body 3 of rectangular plan shape, which has a minor wall 4, and a slightly crowned cover plate 5.

Housed within the base 2 is an electronic unit AE which has a 220-Volt input and delivers a 12-Volt output.

A pushbutton 6 extends through the cover plate 5 and controls the lamp, the cover plate being also formed with passageways 7 for cooling the electronic unit AE.

The lamp 1 comprises a boom 8 which has one end connected to the minor wall 4 of the base 2 by means of a hinge 9 and holds at the other end a bulb socket 10 for an electric bulb 11.

It should be noted that the boom 8 is a thin plate-like construction and can be extended and foreshortened telescopingly in a manner to be described.

The boom 8 is slightly arcuate and formed of three thin plate-like elements, specifically a first U-shaped element 12, second U-shaped element 13, and third substantially rectangular element 14.

The first element 12 has a base 15 and wings **16*a* and 16*b*. It is connected at its base 15 to the minor wall 4 through the aforesaid hinge 9**.

The second element 13 has a base 17 and wings **18*a* and 18*b*. It fits slidably in the first element 12 between the wings 16*a* and 16*b*** of the latter.

The third element 14 fits slidably in the second element 13 between the wings **18*a* and 18*b* of the latter, and carries the bulb socket 10** at its free end.

It should be noted that the elements 12, 13, 14 are formed of respective flattened shells 19 and 20, 21 and 22, 23 and 24, which are mutually juxtaposed and made unitary with one another preferably by heat welding.

Note should also be taken of that the sliding fit between the third element 14 and the second element 13, and between the second element 13 and the first element 12 is implemented by slideways, collectively indicated at 25, in the form of projections 26 of hook-like cross-sectional shape which are associated with the first element 12 and the second element 13, and of grooves 27, having a cross-sectional shape matching the hook-like cross-section, which are associated with the second element 13 and the third element 14 and engaged by said projections.

The hinge 9 comprises two gudgeons **28*a* and 28*b* of metal construction which are spaced apart and associated with the box-type body 3 across the minor wall 4, and two respective metal pins 29*a* and 29*b* which are associated with the first element at the base 15** thereof.

The gudgeons **28*a* and 28*b* are deformable to clutch around their respective pins 29*a* and 29*b* with a predetermined amount of frictional resistance. For the purpose, the gudgeons 28*a* and 28*b* are each provided with a cut 30 and an adjustment screw 41 straddling the cut 30** and acting on the cut legs to deform the gudgeon.

A balancing spring 31 is stretched between a shoulder **32*a* formed on the base 2 and a peg 32*b* protruding off-centered from the pin 29*a***.

The reference 33 denotes an electric connection for electrically connecting the bulb 11 held in the socket 10 to the electronic unit AE.

Said electric connection 33 comprises two cables **34*a* and 34*b* stretched between the electronic unit AE and the gudgeons 28***a* and 28*b* respectively, the gudgeons 28*a* and 28*b*, pins 29*a* and 29*b*, foils 35*a* and 35*b* extending along the wings 16*a* and 16*b* of the first element 12, further foils 36*a* and 36*b* extending along the wings 18*a* and 18*b* of the second element 13, and foils 37*a* and 37*b* extending along the third element 14 in mutually spaced relationship and leading to the bulb socket 10.

The foils 35*a* and 35*b*, and the foils 36*a* and 36*b*, are in electric communication with the foils 36*a* and 36*b*, respectively the foils 37*a* and 37*b*, through ends bent to an angle, as collectively indicated at 38, and forming wiping contacts.

It should be noted that the foils 35*a*, 35*b*, 36*a*, 36*b*, 37*a*, 37*b* are located between the aforesaid juxtaposed shells, and held captive therebetween following heat welding of the shells.

Mounted on the second element 13 and third element 14 are spring-loaded ratchet members, collectively indicated at 39, which are adapted to engage in ratchet sockets, collectively designated 40 and formed in the first element 12 and second element 13 to provide travel end stops for the second element 13 and the third element 14 with the boom fully telescoped out.

In use, the boom can be moved angularly about the hinge point to set the electric bulb at a desired level. This movement is somewhat resisted by the friction between the gudgeons and the pins. During this angular movement, the balancing spring tension is gradually increased as the boom is lowered.

The boom reach can be adjusted to a selected extent. Thanks to the telescoping fit of the elements, the boom can be moved between a fully extended condition, where the ratchet members engage in their respective sockets, and a fully retracted condition where the elements collapse inside one another to form a continuous plate-like element. This continuous plate-like element, with the boom fully down, will come to rest onto the cover plate of the lamp base (see FIG. 5).

A major advantage of the lamp according to the invention is that it provides for an ethereal, yet rigid and lightweight, support of the electric bulb.

A further advantage of the inventive lamp is that it affords an unobstructed viewing field and unusual freedom of movements for the user.

Lastly, it lends itself for aesthetically attractive styling, a non-negligible advantage this one for an article which is apt to enhance the look of its surroundings.

In addition, the lamp of this invention has a straightforward construction, and accordingly, it to be expected that it would provide long-lasting and trouble-free operability.

It stand to reason that a skilled person in the art may choose to introduce several changes and modifications to the lamp described hereinabove for the purpose of meeting specific and contingent demands, without departing by so doing from the true scope of the invention as set forth in the appended claims.

I claim:

1. A study lamp comprising a base, a boom having one end connected to the base by means of a hinge and the other end holding a bulb socket, and an electrical connection between the base and the bulb socket, characterized in that the boom has in a cross-section a thin plate-like profile, said boom including plate-like elements which are in sliding fit inside one another to provide for telescoping extension of said boom.

2. A study lamp according to claim 1, characterized in that three such elements are provided with a first element U-shaped and connected to the base at the cross line of the "U", a second element U-shaped and a sliding fit between the legs of the U-shape of the first element, and a third element holding the bulb socket which is substantially rectangular in outline and a sliding fit between the legs of the U-shape of the second element.

3. A study lamp according to claim 2, characterized in that said elements are formed by respective juxtaposed shells made unitary as by heat welding.

4. A study lamp according to claim 3, characterized in that the hinge comprises two gudgeons associated with the base and two pins associated with the boom, at least one of the gudgeons being deformable to clutch around the pin with a predetermined amount of frictional resistance.

5. A study lamp according to claim 4, characterized in that it comprises a boom balancing spring stretched between a shoulder formed on the base and a peg protruding off-center from the pin.

6. A study lamp according to claim 5, characterized in that the electrical connection includes the gudgeons, pins, and foils extending along the three elements and being placed in electric communication by wiping contacts.

7. A study lamp according to claim 6, characterized in that said foils are located between the juxtaposed shells.

8. A study lamp according to claim 7, characterized in that it comprises spring-loaded ratchet members mounted on the second element and third element and adapted to engage in ratchet sockets formed on the first element and second element to provide travel end stops.

9. A study lamp comprising a base; a boom having a thin plate-like configuration, one end of said boom connected to the base by means of a hinge and the other end holding a bulb socket, said boom including plate-like elements which are slidingly fit inside one another to provide for telescoping extension of said boom, said elements including a first element U-shaped and connected to the base at a cross line of the "U", a second element U-shaped and slidingly fit between the legs of the U-shape of the first element, and a third element holding the bulb socket slidingly fit between the legs of the U-shape of the second element; and an electrical connection between the base and the bulb socket.

10. A study lamp according to claim 9, characterized in that said third element is substantially rectangular in outline.

11. A study lamp comprising a base; a boom having one end connected to the base by means of a hinge and the other end holding a bulb socket, and an electrical connection between the base and the bulb socket, characterized in that the boom has in cross-section a thin plate-like profile, said boom including a plurality of elements each having in cross-section a thin plate-like profile, at least one element having a U-shaped opening for telescopingly receiving another of said elements, whereby said boom has a thin plate-like profile when said elements are fully telescopically received and fully telescopically extended with respect to each other.

* * * * *

UNITED STATES PATENT AND TRADEMARK OFFICE

CERTIFICATE OF CORRECTION

PATENT NO. : 5,065,297

DATED : November 12, 1991

INVENTOR(S) : Angelo Santambrogio

It is certified that error appears in the above-identified patent and that said Letters Patent is hereby corrected as shown below:

Column 1, after line 23 "drawbacks" insert new paragraph --This problem is solved by a lamp as indicated being characterized in that the boom has a thin plate-like configuration.

Column 3, line 53, "stand" should read --stands--.

Column 3, line 64, delete "a" before cross-section.

Signed and Sealed this

Thirtieth Day of March, 1993

*Attest:*

STEPHEN G. KUNIN

*Attesting Officer*

*Acting Commissioner of Patents and Trademarks*